US011648606B2

(12) United States Patent
Li et al.

(10) Patent No.: US 11,648,606 B2
(45) Date of Patent: May 16, 2023

(54) COOLING WATER CHANNEL FOR CASTING MOLD

(71) Applicant: CITIC Dicastal Co., Ltd., Qinhuangdao (CN)

(72) Inventors: Zhen Li, Qinhuangdao (CN); Zuo Xu, Qinhuangdao (CN); Hanqi Wu, Qinhuangdao (CN); Zhihua Zhu, Qinhuangdao (CN); Guoyuan Xiong, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 126 days.

(21) Appl. No.: 17/367,502

(22) Filed: Jul. 5, 2021

(65) Prior Publication Data

US 2022/0040753 A1 Feb. 10, 2022

(30) Foreign Application Priority Data

Aug. 4, 2020 (CN) ..... 202010772141.0

(51) Int. Cl.
*B22C 9/06* (2006.01)
*B22C 9/28* (2006.01)

(52) U.S. Cl.
CPC ..... *B22C 9/065* (2013.01); *B22C 9/28* (2013.01)

(58) Field of Classification Search
CPC ..... B22C 9/065; B22C 9/28
See application file for complete search history.

(56) References Cited

FOREIGN PATENT DOCUMENTS

CN 106077575 A * 11/2016

* cited by examiner

*Primary Examiner* — Kevin E Yoon
*Assistant Examiner* — Jacky Yuen
(74) *Attorney, Agent, or Firm* — IPro, PLLC

(57) ABSTRACT

The application provides a cooling water channel for a casting mold. The cooling water channel adopts a sealing structure in which a water channel insert, a sealing cover plate and a metal corrugated sealing ring are matched with each other, wherein a bottom surface of the metal corrugated sealing ring is corrugated or two side walls of the metal corrugated sealing ring are corrugated, and the sealing cover plate is pressed to enable the metal corrugated sealing ring to generate elastic deformation, so that corrugations on the two side walls of the metal corrugated sealing ring and a side wall of the water channel form multi-point contact or the bottom surface of the metal corrugated sealing ring expands to make the side walls of the metal corrugated sealing ring in tight contact with the water channel to achieve a water channel sealing effect.

9 Claims, 5 Drawing Sheets

COOLING WATER CHANNEL FOR CASTING MOLD

TECHNICAL FIELD

The present application relates to the technical field of casting molds, in particular to a cooling water channel for a casting mold.

BACKGROUND

The aluminum wheel manufacturing industry has fierce competition and increasing cost pressure. Therefore, on the premise of ensuring the product quality, improving the production efficiency is an effective means to reduce cost. A water cooling mold has the advantages of high cooling intensity, obvious improvement of casting efficiency and product performance, etc. All major hub manufacturing enterprises are devoting greater efforts to research and develop the related water cooling technology. The water cooling mold is widely applied to mass production. However, at present, there are some problems in the water cooling mold, and one of the obvious problems is water leakage of a water channel. At present, a water channel of a mold is sealed by welding. The welding quality and the sealing quality are not ensured stably due to different welding levels of skilled workers. A weld joint is prone to fatigue cracking due to the change of temperature and stress in the production process, but water leakage of the water channel directly leads to that the mold cannot continue to be used, and the mold needs to be disassembled from a die casting machine, which will directly disrupt the production plan. Moreover, the mold is very difficult to maintain, and requires frequent grinding and repair welding, so that the maintenance cost of the mold is increased, and the related economic loss may reach millions of yuan every year.

SUMMARY

An embodiment of the present application provides a cooling water channel for a casting mold. The traditional welding sealing is replaced by a mechanically matched sealing mode, so that it is not liable to cause fatigue cracking and water leakage in the production process of the mold while the sealing effect is achieved; and furthermore, machining and manufacturing are easy, the maintenance difficulty of the mold is low and the production cost may be obviously reduced.

To achieve the above objectives, the present application provides the following technical solution.

In an embodiment of the present application, a cooling water channel for a casting mold is provided. The cooling water channel includes a water channel insert, a sealing cover plate and a metal corrugated sealing ring, wherein a channel groove is formed in the water channel insert, and the sealing cover plate covers the channel groove to seal the channel groove; and the metal corrugated sealing ring is arranged in the channel groove, a cross section of the metal corrugated sealing ring is substantially U-shaped, the metal corrugated sealing ring includes a bottom surface and two side walls, the bottom surface is corrugated or the two side walls are corrugated, and the sealing cover plate is pressed on the metal corrugated sealing ring to make the metal corrugated sealing ring generate elastic deformation. In this embodiment, a sealing structure in which the water channel insert, the sealing cover plate and the metal corrugated sealing ring are matched with each other is adopted, and the sealing cover plate is pressed tightly to enable the metal corrugated sealing ring to generate elastic deformation, so that corrugations and the side walls of the water channel form multi-point contact or the side walls of the metal corrugated sealing ring are in tight contact with the water channel to achieve a water channel sealing effect; meanwhile, fatigue cracking and water leakage cannot easily occur in the production process of the mold; and furthermore, machining and manufacturing are easy, the mold maintenance difficulty is low, and the production cost may be obviously reduced.

In some embodiments, a U-shaped opening directly faces a bottom of the channel groove, the sealing cover plate is pressed on the bottom surface, the two side walls cling to an inner wall of the channel groove, and the two side walls are in contact with the bottom of the channel groove. In this embodiment, a cooling water flow chamber is formed between the metal corrugated sealing ring and the channel groove, so that a better sealing effect can be achieved.

In some embodiments, the cooling water channel further includes a water inlet pipe and a water outlet pipe; the sealing cover plate is provided with a first through hole and a second through hole, and a third through hole and a fourth through hole are formed in positions, corresponding to the first through hole and the second through hole, of the bottom surface of the metal corrugated sealing ring; the water inlet pipe passes through the first through hole and the third through hole to extend into the channel groove; and the water outlet pipe passes through the second through hole and the fourth through hole to extend into the channel groove. In this embodiment, the water inlet pipe and the water outlet pipe are arranged in the cooling water channel, so that cooling water can flow. The cooling water enters through the water inlet pipe, flows along the direction of the cooling water channel and flows out from the water outlet pipe to take away heat of the mold. The flow velocity and the flow of the cooling water may be controlled by adjusting the input pressure of the cooling water and a flow adjusting valve, so that the overall temperature of the casting mold is adjusted.

In some embodiments, the U-shaped opening directly faces the sealing cover plate, the sealing cover plate is pressed on the two side walls, the two side walls cling to the inner wall of the channel groove, and the bottom surface is in contact with the bottom of the channel groove. In this embodiment, a cooling water flow chamber is formed between the metal corrugated sealing ring and the sealing cover plate, so that a better sealing effect also can be achieved.

In some embodiments, the cooling water channel further includes a water inlet pipe and a water outlet pipe; the sealing cover plate is provided with a first through hole and a second through hole, the water inlet pipe passes through the first through hole to extend into the channel groove, and the water outlet pipe passes through the second through hole to extend into the channel groove. In this embodiment, the water inlet pipe and the water outlet pipe are arranged in the cooling water channel, so that cooling water can flow. The cooling water enters through the water inlet pipe, flows along the direction of the cooling water channel and flows out from the water outlet pipe to take away heat of the mold. The flow velocity and the flow of the cooling water may be controlled by adjusting the input pressure of the cooling water and a flow adjusting valve, so that the overall temperature of the casting mold is adjusted.

In some embodiments, the water channel insert, the sealing cover plate and the metal corrugated sealing ring are all annular. This is to adapt to water-cooling casting of metal hub molds for pressure casting, gravity casting and the like.

In some embodiments, a material of the metal corrugated sealing ring is one of metal materials with a certain elasticity, such as stainless steel, copper, phosphorus bronze, beryllium bronze and manganese steel. In this way, the metal corrugated sealing ring is an elastic component, which can perform elastic deformation, and the elasticity enables the side wall of the sealing ring to be in tight contact with the water channel, thereby having a better sealing effect.

In some embodiments, the water channel insert and the sealing cover plate are fixed on the casting mold through spot welding, so that the mold is convenient to maintain in the later stage and the maintenance cost is low. The sealing cover plate and the metal corrugated sealing ring may be taken out sequentially for maintenance only by removing the fixed welding sports during maintenance. Compared with the traditional water channel welding structure in which the water channel can be removed by machining, the cooling water channel is greatly improved in the aspect of the maintenance difficulty and the cost. Of course, in some other embodiments, it is also feasible that the water channel insert and the sealing cover plate are fixedly connected to the casting mold through bolts.

In some embodiments, preferably, a roughness of an inner side wall of the channel groove is Ra1.6-Ra0.8, and the side walls of the metal corrugated sealing ring can be in tight contact with the inner side wall of the channel groove, thereby having a better sealing effect.

Compared with the prior art, the present application has the following beneficial effects:

the present application provides the cooling water channel for the casting mold. The cooling water channel adopts the sealing structure in which the water channel insert, the sealing cover plate and the metal corrugated sealing ring which are matched with each other, wherein the bottom surface of the metal corrugated sealing ring is corrugated or the two side walls of the metal corrugated sealing ring are corrugated, and the sealing cover plate is pressed tightly to enable the metal corrugated sealing ring to generate elastic deformation, so that corrugations on the two side walls of the metal corrugated sealing ring and the side wall of the water channel form multi-point contact or the bottom surface of the metal corrugated sealing ring expands to make the side walls of the metal corrugated sealing ring in tight contact with the water channel to achieve a water channel sealing effect; meanwhile, fatigue cracking and water leakage are not liable to occur in the production process of the mold; and furthermore, machining and manufacturing are easy, the mold maintenance difficulty is low, and the production cost can be obviously reduced.

Figure 1:
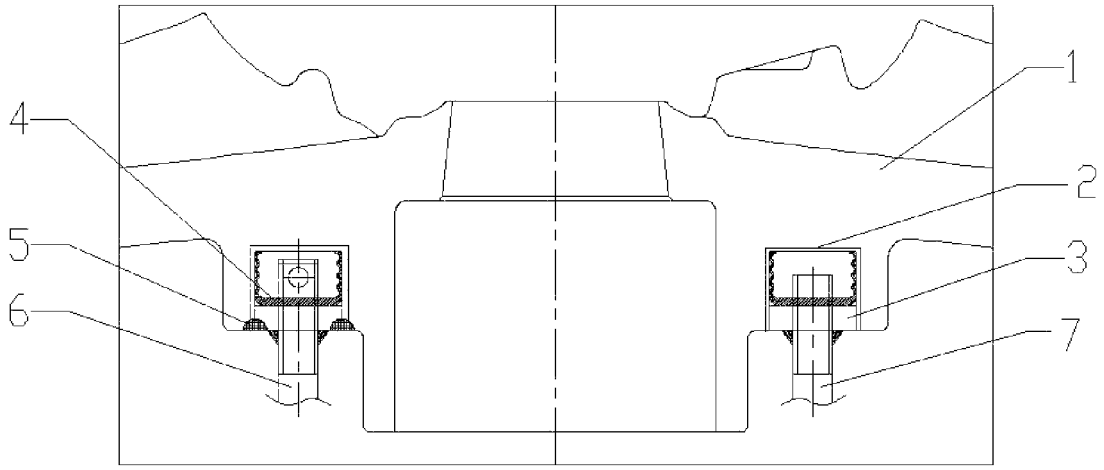
FIG. 1 is a structural schematic diagram I of assembly of a cooling water channel for a casting mold according to the present application.

In the drawings: 1—hub mold, 2—water channel inert, 3—sealing cover plate, 4—metal corrugated sealing ring, 5—welding spot, 6—water inlet pipe, 7—water outlet pipe.

DETAILED DESCRIPTION OF THE EMBODIMENTS

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

Embodiment 1

The traditional cooling water channel sealing adopts welding sealing. The welding quality and the sealing quality are not ensured stably due to different welding levels of skilled workers. A weld joint is prone to fatigue cracking due to the change of temperature and stress in the production process, but water leakage of the water channel directly leads to that the mold cannot continue to be used, and the mold needs to be disassembled from a die casting machine, which will directly disrupt the production plan. Moreover, the mold is very difficult to maintain, and requires frequent grinding and repair welding, so that the maintenance cost of the mold is increased, and the related economic loss may reach millions of yuan every year. Secondly, in the traditional cooling water channel, interference fit of the water channel insert is required, and the water channel insert is assembled after being cooled by liquid nitrogen, so that the operation is complicated and the cost is high.

As shown in FIG. 1, in the embodiment 1 of the present application, a cooling water channel for a casting mold is provided. The cooling water channel for the casting mold includes a water channel insert 2, a sealing cover plate 3, a metal corrugated sealing ring 4, a water inlet pipe 6 and a water outlet pipe 7. The water channel insert 2, the sealing cover plate 3 and the metal corrugated sealing ring 4 are all annular. A channel groove is formed in the water channel insert 2, and the sealing cover plate 3 covers the channel groove to seal the channel groove.

Figure 4:
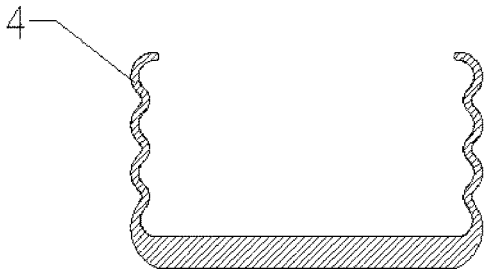
FIG. 4 is a structural schematic diagram I of a cross section of a metal corrugated sealing ring of a cooling water channel for a casting mold according to the present application.
Figure 5:
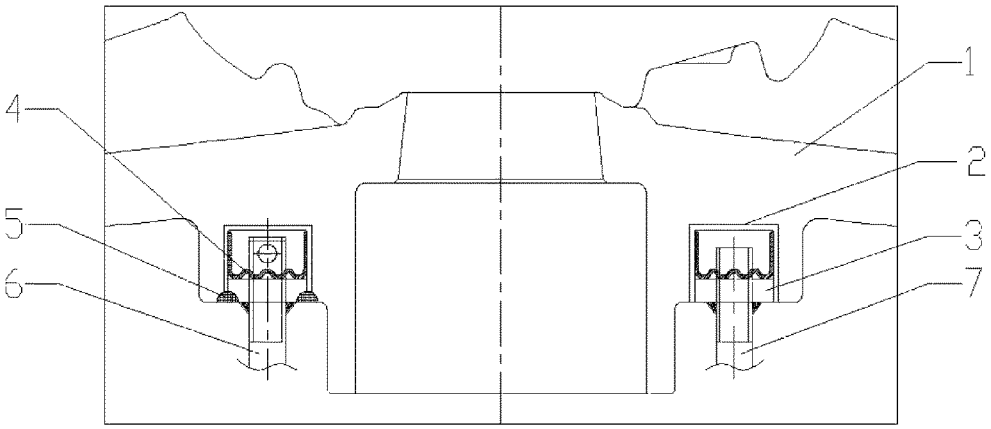
FIG. 5 is a structural schematic diagram II of assembly of a cooling water channel for a casting mold according to the present application.
Figure 6:
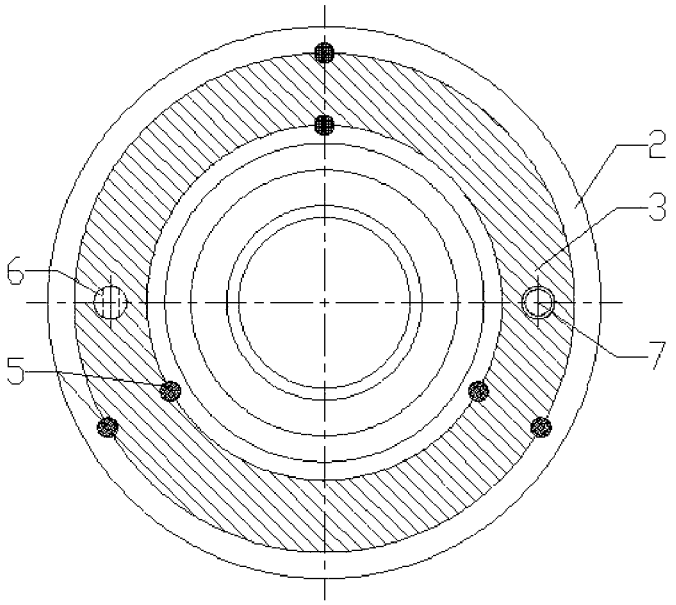
FIG. 6 is a structural schematic diagram II of spot welding at a bottom of a cooling water channel for a casting mold according to the present application.

The metal corrugated sealing ring 4 is arranged in the channel groove. As shown in FIG. 1 to FIG. 4, a cross section of the metal corrugated sealing ring 4 is substantially U-shaped, and a U-shaped opening directly faces a bottom of the channel groove. The metal corrugated sealing ring 4 includes a bottom surface and two side walls, wherein the two side walls are corrugated, as shown in FIG. 4. A material, of the metal corrugated sealing ring 4 is one of metal materials with a certain elasticity such as stainless steel, copper, phosphorus bronze, beryllium bronze and manganese steel. In this way, the metal corrugated sealing ring 4 is an elastic component, which can perform elastic deformation, and the elasticity enables the side walls of the sealing ring to be in tight contact with the water channel, thereby having a better sealing effect. The sealing cover plate 3 is pressed on the bottom surface of the metal corrugated sealing ring 4 to enable the metal corrugated sealing ring 4 to generate elastic deformation, the two side walls cling to an inner wall of the channel groove, and the two side walls are in contact with the bottom of the channel groove.

The sealing cover plate 3 is provided with a first through hole and a second through hole, and a third through hole and a fourth through hole are formed in positions, corresponding to the first through hole and the second through hole, of the bottom surface of the metal corrugated sealing ring 4. The water inlet pipe 6 passes through the first through hole and the third through hole to extend into the channel groove, and the water outlet pipe 7 passes through the second through hole and the fourth through hole to extend into the channel groove.

Figure 2:
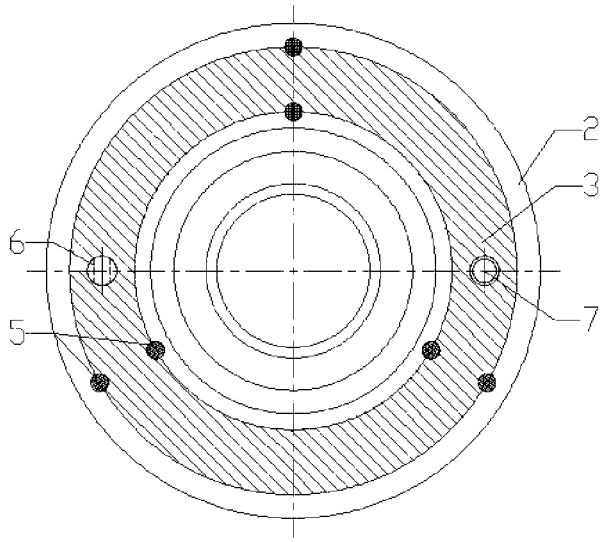
FIG. 2 is a structural schematic diagram I of spot welding at a bottom of a cooling water channel for a casting mold according to the present application.
Figure 3:
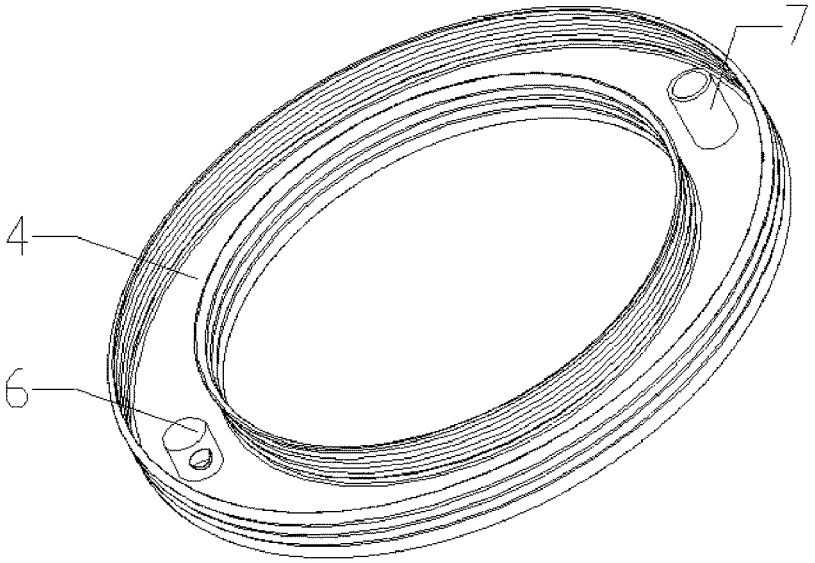
FIG. 3 is a schematic diagram I of a three-dimensional structure of a metal corrugated sealing ring of a cooling water channel for a casting mold according to the present application.

With reference to FIG. 2 of the specification, in the embodiment 1, since a sealing structure in which the water channel insert, the sealing cover plate and the metal corrugated sealing ring are matched with each other is adopted, the water channel insert and the sealing cover plate are fixed on the casting mold through spot welding, so that the mold is convenient to maintain in the later stage and the maintenance cost is low. The sealing cover plate and the metal corrugated sealing ring may be taken out sequentially for maintenance only by removing fixed welding sports during maintenance. Compared with the traditional water channel welding structure in which the water channel can be removed by machining, the cooling water channel is greatly improved in the aspect of the maintenance difficulty and the cost. Of course, in some other embodiments, it is also feasible that the water channel insert and the sealing cover plate are fixedly connected to the casting mold through bolts, and maintenance may also be conducted by disassembling the bolts in the later stage.

In actual production, the casting mold adopts casting mold steel, the annular water channel is machined first, the mechanical requirements are lowered in consideration of the machining difficulty, preferably, a roughness of an inner side wall of the channel groove is machined to be Ra1.6-Ra0.8, and the side walls of the metal corrugated sealing ring can be in tight contact with the inner side wall of the channel groove, thereby having a better sealing effect. In some other embodiments, according to the machining mechanical property, when the inner side wall of the channel groove with a lower roughness (for example, Ra<0.4) is machined, a better sealing effect can also be achieved. Secondly, the metal corrugated sealing ring is customized, the material is stainless steel, the thickness of an end face is 3 mm, the wall thickness at the corrugation is 1.5 mm, and the metal corrugated sealing ring will expand outwards after being heated in the casting production process, thereby ensuring the sealing effect. Then, the metal corrugated sealing ring is assembled into the channel groove of the cooling water channel of the mold, a sealing pressing plate is mounted, pressure is applied to the pressing plate, so that the metal corrugated sealing ring generates elastic deformation, corrugations on the two side walls of the metal corrugated sealing ring and the side wall of the water channel form multi-point contact, and the water channel sealing effect is achieved; and the mold and the sealing cover plate are subjected to spot welding to achieve a fixing effect. Finally, the water inlet pipe and the water outlet pipe are mounted, and pipe orifices are sealed by welding.

In the embodiment 1, the cooling water channel for the casting mold is provided. The sealing structure in which the water channel insert, the sealing cover plate and the metal corrugated sealing ring are matched with each other is adopted. The metal corrugated sealing ring is very easy and convenient to assemble and may be directly assembled into the cooling water channel at normal temperature without being cooled by liquid nitrogen. Secondly, the two side walls of the metal corrugated sealing ring are corrugated, and the sealing cover plate is pressed tightly to enable the metal corrugated sealing ring to generate elastic deformation, so that the corrugations on the two side walls of the metal corrugated sealing ring and the side wall of the water channel form multi-point contact, and the water channel sealing effect is achieved; meanwhile, the metal corrugated sealing ring is an elastic component and may counteract the cold and hot shrinkage deformation of the mold in the production process, and the sealing effect will not be compromised due to mold deformation. In addition, in the embodiment 1, the cooling water channel with the sealing structure is not liable to cause fatigue cracking and water leakage in the production process of the mold; furthermore, machining and manufacturing are easy, the mold maintenance difficulty is low, and the production cost can be obviously reduced. The sealing cover plate and the metal corrugated sealing ring may be taken out sequentially for maintenance only by removing the fixed welding sports during maintenance. Compared with the traditional water channel welding structure in which the water channel can be removed by machining, the cooling water channel is greatly improved in the aspect of the maintenance difficulty and the cost.

Embodiment 2

Figure 7:
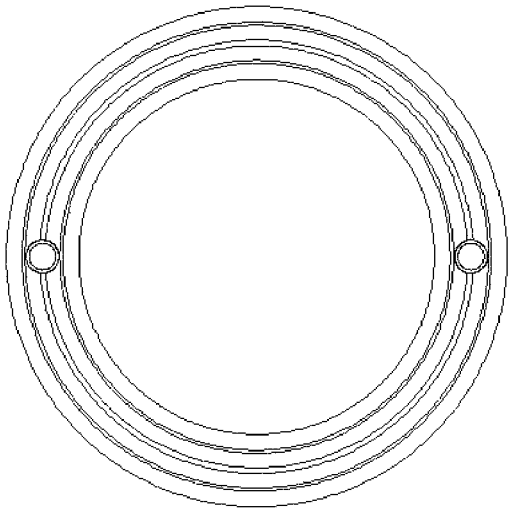
FIG. 7 is a schematic diagram II of a three-dimensional structure of a metal corrugated sealing ring of a cooling water channel for a casting mold according to the present application.
Figure 8:
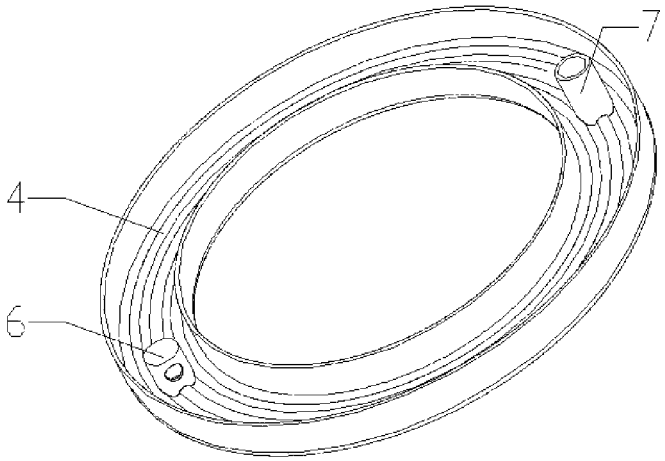
FIG. 8 is a top view of a metal corrugated sealing ring of a cooling water channel for a casting mold according to the present application.
Figure 9:
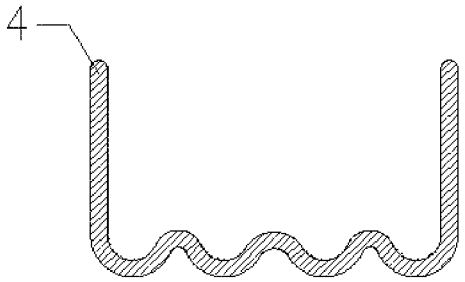
FIG. 9 is a structural schematic diagram II of a cross section of a metal corrugated sealing ring of a cooling water channel for a casting mold according to the present application.

As shown in FIG. 5 to FIG. 9, the embodiment 2 of the present application provides a cooling water channel for a casting mold. The embodiment 2 differs from the embodiment 1 in that: the metal corrugated sealing ring 4 has a different structure, as shown in FIG. 7 to FIG. 9. Specifically, in the embodiment 2, a bottom surface of the metal corrugated sealing ring is corrugated. In the embodiment 2, the sealing cover plate 3 is pressed on the bottom surface of the metal corrugated sealing ring 4 to enable the metal corrugated sealing ring 4 to generate elastic deformation, so that the bottom surface of the metal corrugated sealing ring 4 expands to make the side walls of the metal corrugated sealing ring 4 in tight contact with the water channel, thereby achieving a water channel sealing effect.

Embodiment 3

Figure 10:
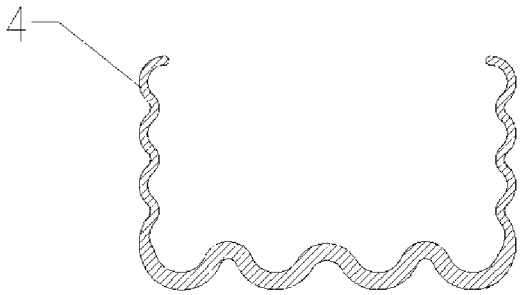
FIG. 10 is a structural schematic diagram III of a cross section of a metal corrugated sealing ring of a cooling water channel for a casting mold according to the present application.

The embodiment 3 provides a cooling water channel for a casting mold. The embodiment 3 differs from the embodiment 1 in that: the metal corrugated sealing ring 4 has a different structure, as shown in FIG. 10. Specifically, in the embodiment 3, a bottom surface and two side walls of the metal corrugated sealing ring are corrugated. In the embodiment 3, the sealing cover plate 3 is pressed on the bottom surface of the metal corrugated sealing ring 4 to enable the metal corrugated sealing ring 4 to generate elastic deformation, so that the bottom surface of the metal corrugated sealing ring 4 expands to make the side walls of the metal corrugated sealing ring 4 in tight contact with the side wall of the channel groove of the water channel insert; meanwhile, the corrugations of the two side walls of the metal corrugated sealing ring 4 and the side wall of the channel groove of the water channel insert form multi-point contact, so that a better water channel sealing effect is achieved; in addition, the bottom surface and the two side walls of the metal corrugated sealing ring are corrugated, so that the adaptability of the metal corrugated sealing ring to the casting environment is enhanced, the cold and hot shrinkage deformation of the mold in the production process may be counteracted, and the sealing effect cannot be compromised due to mold deformation.

Embodiment 4

Figure 11:
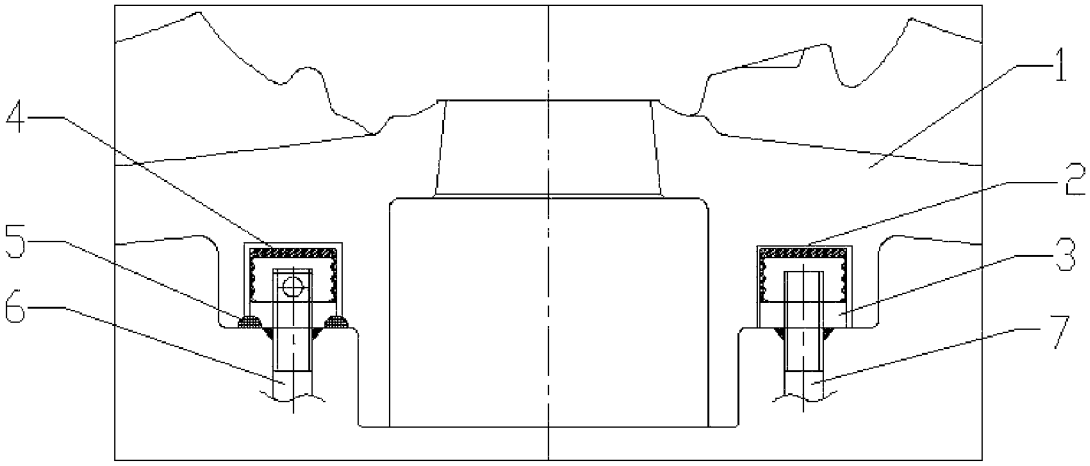
FIG. 11 is a structural schematic diagram III of assembly of a cooling water channel for a casting mold according to the present application.

The embodiment 4 provides a cooling water channel for a casting mold. The embodiment 4 differs from the embodiment 1 in an assembling direction of the metal corrugated sealing ring. In the embodiment 4 and the embodiment 1, the assembling directions of the metal corrugated sealing rings are reversed. Specifically, as shown in FIG. 11, in the embodiment 4, the cross section of the metal corrugated sealing ring 4 is substantially U-shaped, the U-shaped opening directly faces the sealing cover plate 3, the metal corrugated sealing ring 4 includes a bottom surface and two side walls, the two side walls are corrugated, the two side walls cling to an inner wall of the channel groove and the bottom surface is in contact with the bottom of the channel groove, and the sealing cover plate is pressed on the two side walls of the metal corrugated sealing ring to enable the metal corrugated sealing ring to generate elastic deformation. Meanwhile, the sealing cover plate 3 is provided with a first through hole and a second through hole, the water inlet pipe 6 passes through the first through hole to extend into the channel groove, and the water outlet pipe 7 passes through the second through hole to extend into the channel groove.

In the embodiment 4, the sealing cover plate 3 is pressed on the two side walls of the metal corrugated sealing ring 4 to enable the metal corrugated sealing ring 4 to generate elastic deformation, so that the corrugations of the two side walls of the metal corrugated sealing ring 4 and the side wall of the channel groove of the water channel insert form multi-point contact, and a better water channel sealing effect is achieved.

Embodiment 5

The embodiment 5 provides a cooling water channel for a casting mold. The embodiment 5 differs from the embodiment 4 in that: the metal corrugated sealing ring 4 has a different structure. Specifically, in the embodiment 5, the bottom surface of the metal corrugated sealing ring is corrugated. In the embodiment 5, the sealing cover plate 3 is pressed on the two side walls of the metal corrugated sealing ring 4 and compresses the corrugations of the bottom surface to enable the metal corrugated sealing ring 4 to generate elastic deformation, so that the bottom surface of the metal corrugated sealing ring 4 expands to make the side walls of the metal corrugated sealing ring 4 in tight contact with the water channel, thereby achieving a water channel sealing effect.

Embodiment 6

The embodiment 6 provides a cooling water channel for a casting mold. The embodiment 6 differs from the embodiment 4 in that: the metal corrugated sealing ring 4 has a different structure. Specifically, in the embodiment 6, a bottom surface and two side walls of the metal corrugated sealing ring are corrugated. In the embodiment 6, the sealing cover plate 3 is pressed on the two side walls of the metal corrugated sealing ring 4 and compresses the corrugations of the bottom surface to enable the metal corrugated sealing ring 4 to generate elastic deformation, so that the bottom surface of the metal corrugated sealing ring 4 expands to make the side walls of the metal corrugated sealing ring 4 in tight contact with the side wall of the channel groove of the water channel insert; meanwhile, the corrugations of the two side walls of the metal corrugated sealing ring 4 and the side wall of the channel groove of the water channel insert form multi-point contact, so that a better water channel sealing effect is achieved; and in addition, the bottom surface and the two side walls of the metal corrugated sealing ring are corrugated, so that the adaptability of the metal corrugated sealing rig to the casting environment is enhanced, the cold and hot shrinkage deformation of the mold in the production process may be counteracted, and the sealing effect cannot be compromised due to mold deformation.

What is claimed is:

1. A cooling water channel for a casting mold, comprising a water channel insert, a sealing cover plate and a metal corrugated sealing ring, wherein a channel groove is formed in the water channel insert, and the sealing cover plate covers the channel groove to seal the channel groove; and the metal corrugated sealing ring is arranged in the channel groove, a cross section of the metal corrugated sealing ring is substantially U-shaped, the metal corrugated sealing ring comprises a bottom surface and two side walls, the bottom surface is corrugated or the two side walls are corrugated, and the sealing cover plate is pressed on the metal corrugated sealing ring to make the metal corrugated sealing ring generate elastic deformation.

2. The cooling water channel for the casting mold according to claim 1, wherein a U-shaped opening directly faces a bottom of the channel groove, the sealing cover plate is pressed on the bottom surface, the two side walls cling to an inner wall of the channel groove, and the two side walls are in contact with the bottom of the channel groove.

3. The cooling water channel for the casting mold according to claim 2, further comprising a water inlet pipe and a water outlet pipe, wherein the sealing cover plate is provided with a first through hole and a second through hole, and a third through hole and a fourth through hole are formed in positions, corresponding to the first through hole and the second through hole, of the bottom surface of the metal corrugated sealing ring; the water inlet pipe passes through the first through hole and the third through hole to extend into the channel groove; and the water outlet pipe passes through the second through hole and the fourth through hole to extend into the channel groove.

4. The cooling water channel for the casting mold according to claim 1, wherein the U-shaped opening directly faces the sealing cover plate, the sealing cover plate is pressed on the two side walls, the two side walls cling to the inner wall of the channel groove, and the bottom surface is in contact with the bottom of the channel groove.

5. The cooling water channel for the casting mold according to claim 4, further comprising a water inlet pipe and a water outlet pipe, wherein the sealing cover plate is provided with a first through hole and a second through hole, the water inlet pipe passes through the first through hole to extend into the channel groove, and the water outlet pipe passes through the second through hole to extend into the channel groove.

6. The cooling water channel for the casting mold according to claim 1, wherein the water channel insert, the sealing cover plate and the metal corrugated sealing ring are all annular.

7. The cooling water channel for the casting mold according to claim 1, wherein a material of the metal corrugated sealing ring is one of stainless steel, copper, phosphorus bronze, beryllium bronze and manganese steel.

8. The cooling water channel for the casting mold according to claim 1, wherein the water channel insert and the sealing cover plate are fixed on the casting mold through spot welding.

9. The cooling water channel for the casting mold according to claim 1, wherein a roughness of an inner side wall of the channel groove is Ra1.6-Ra0.8.

* * * * *